US007238127B2

(12) United States Patent
Al-Harbi

(10) Patent No.: US 7,238,127 B2
(45) Date of Patent: Jul. 3, 2007

(54) LIMITED CONTACT ATHLETIC GAME

(76) Inventor: Hussain Saleh Al-Harbi, Block No. 1, St. 13, House No. 784, Sabahia (KW)

( * ) Notice: Subject to any disclaimer, the term of this patent is extended or adjusted under 35 U.S.C. 154(b) by 75 days.

(21) Appl. No.: 10/291,479

(22) Filed: Nov. 12, 2002

(65) Prior Publication Data

US 2004/0090011 A1 May 13, 2004

(51) Int. Cl.

| | |
|---|---|
| ***A63B 69/00*** | (2006.01) |
| ***A63B 69/28*** | (2006.01) |
| ***A63B 69/30*** | (2006.01) |
| ***A63C 19/00*** | (2006.01) |

(52) U.S. Cl. ..... 473/426; 472/93; 482/89

(58) Field of Classification Search ..... 473/108, 473/429, 426, 575; 472/92, 93; 273/393, 273/386; D21/466, 787; 482/83, 86, 90
See application file for complete search history.

(56) References Cited

U.S. PATENT DOCUMENTS

| | | | | |
|---|---|---|---|---|
| 264,931 | A * | 9/1882 | Cook | 482/89 |
| 299,091 | A * | 5/1884 | Rumsy | 482/89 |
| 318,766 | A * | 5/1885 | Longden | 482/89 |
| 426,944 | A * | 4/1890 | Lovatt | 482/89 |
| 708,573 | A * | 9/1902 | Miles | 482/89 |
| 770,869 | A * | 9/1904 | Roe | 482/89 |
| 773,167 | A * | 10/1904 | Spink | 273/333 |
| 2,045,972 | A * | 6/1936 | Tompkins | 482/89 |
| 2,243,943 | A * | 6/1941 | Bunting | 472/93 |
| 3,747,929 | A * | 7/1973 | Burke | 273/386 |
| 4,462,599 | A * | 7/1984 | Brown | 473/430 |
| 4,523,762 | A * | 6/1985 | Garner, Sr. | 473/473 |
| 4,557,478 | A * | 12/1985 | Levine | 482/89 |
| 4,679,793 | A * | 7/1987 | Gonzalez | 273/317.3 |
| 4,749,185 | A * | 6/1988 | Spears | 482/89 |
| 5,046,724 | A * | 9/1991 | Sotomayer | 482/90 |
| 5,542,894 | A * | 8/1996 | Jordan | 482/83 |
| 6,348,028 | B1 * | 2/2002 | Cragg | 482/148 |
| 6,375,600 | B1 * | 4/2002 | Mallette | 482/86 |

FOREIGN PATENT DOCUMENTS

FR 2614346 A1 * 10/1988

* cited by examiner

*Primary Examiner*—Eugene Kim
*Assistant Examiner*—Alvin A. Hunter, Jr.
(74) *Attorney, Agent, or Firm*—Lowe Hauptman & Berner, LLC

(57) ABSTRACT

A limited contact boxing game and apparatus for playing the game includes a platform having an upper surface for supporting two individuals in a standing or crouched position. A platform is preferably in the shape of a square boxing ring and may be elevated and/or include a set of ropes surrounding the platform. The upper surface of the platform includes two or more spaced apart designated boundary areas of equal size and a tethered ball disposed in the space between the two designated areas. The tethered ball is adapted to be struck by each of the individuals toward the other in order to obtain a score by striking the individuals head or body or by causing the individual to step out of their designated boundary area.

3 Claims, 1 Drawing Sheet

LIMITED CONTACT ATHLETIC GAME

FIELD OF THE INVENTION

This invention relates to a limited contact athletic game and apparatus for use in playing the game and more particularly to a limited contact boxing game or the like and apparatus which includes a tethered ball.

BACKGROUND FOR THE INVENTION

Various games have been developed in which a ball, similar to volley ball or soccer ball is tethered. Such games are typically played in confined areas such as a small residential backyard and the movement of the ball is restricted. For example, it is well known to attach a tethered ball to an upright pole. With such apparatus, the ball is struck with the hand or fist during play of the game and the tethered ball rotates around the support pole in a relatively limited arc of travel.

Another approach to a tethered ball game apparatus is disclosed in U.S. Pat. No. 4,523,762 of Garner, Sr. As disclosed therein, the game apparatus includes a generally rectangular playing field within a pair of spaced, parallel side lines and a pair of support posts positioned outside the playing field. A support line extends between the pair of support posts and is attached to the posts at their upper ends. The support line bisects the playing field and extends parallel to the base lines. The tethered line is attached to the support line by means of a tethered line ring and a playing ball is attached to the opposite end so that the playing ball may be struck by one or more players on either side of the support line and caused to travel repeatedly over the support line.

A boxing game which incorporates an adjustable pendulum is disclosed in U.S. Pat. No. 4,679,793 of Gonzalez. As disclosed therein, a table game simulates the action of a boxing contest or the like. The game includes a flat board with players and markers and adjustable pendulum used by the players to knock over the opponents game pieces.

While games using a tethered ball have been played in confined areas, it is presently believed that there may be a demand for a tethered ball game based on the sport of boxing. Such games in accordance with the present invention allow two or more individuals to actively participate in a boxing match without actually striking an opponent or being directly struck by the opponent. Nevertheless, the game and apparatus according to the present invention provide a vigorous and enjoyable workout and allow individuals to participate in a modified form of boxing while reducing the risk of serious injury.

Further, the limited contact boxing game and apparatus in accordance with the present invention can be easily adapted to the skills of the participants, for various ages and weight groups, and for emphasis on speed or strength. In addition, the apparatus may be modified for other sports such as kickboxing etc.

BRIEF SUMMARY OF THE INVENTION

In essence, the present invention contemplates a limited contact boxing game and apparatus for playing the game. The game is played on a platform or other designated surface. The platform has an upper surface for supporting two individuals or participants in a standing or crouched position. In a preferred embodiment of the invention, the platform is in the shape of a square or rectangular boxing ring and may be elevated and/or include a set of ropes surrounding the platform. Ropes are not included in the presently preferred embodiment of the game which is analogous to a cross between the sport of boxing and Sumo. The upper surface of the platform includes two or more spaced apart designated boundary areas of generally equal size with one of the boundary areas for each participant. A tethered ball and means for supporting the tethered ball between the individual or participants are provided and the tethered ball is adapted to be struck by one of the individuals in order to propel the ball toward the other individual. One or more points are scored for striking the body of the other individual or by causing the other individual to step out of their designated boundary area.

The invention will now be described in connection with the accompanying drawings wherein like reference numbers have been used to designate like parts.

DESCRIPTION OF THE PREFERRED EMBODIMENT OF THE INVENTION

Figure 1:
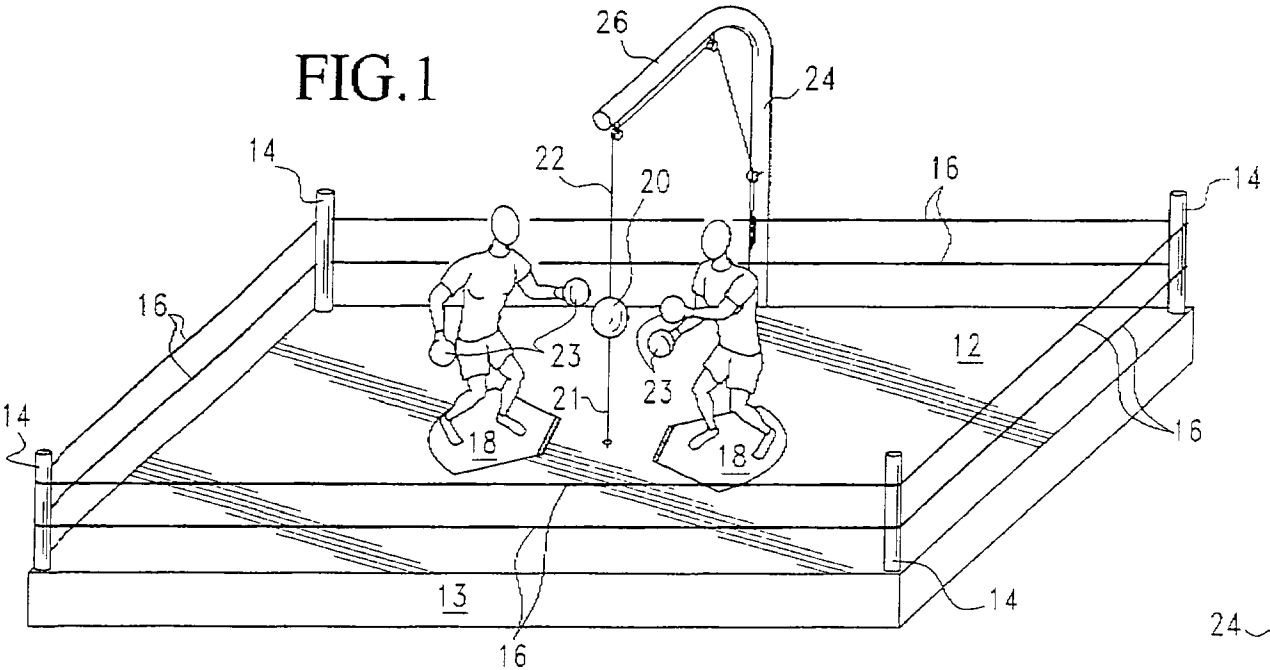
FIG. 1 is a perspective view showing a limited contact boxing game and apparatus therefore in accordance with one embodiment of the present invention.
Figure 4:
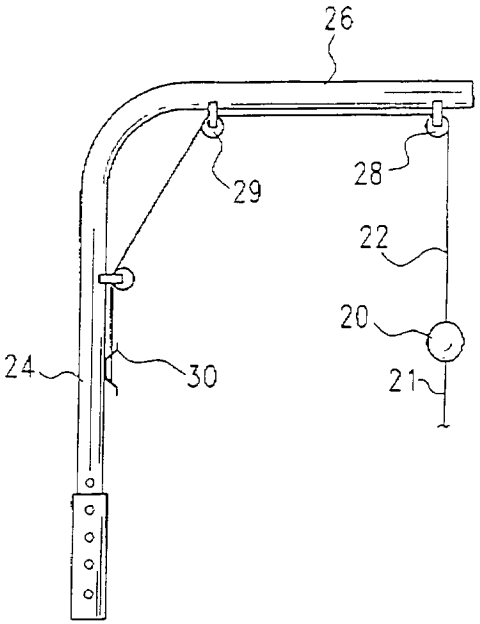
FIG. 4 is a side elevational view of a tethered ball and its suspension apparatus.

A limited contact boxing game or "boxing ball game" and apparatus for playing the game in accordance with a preferred embodiment of the invention are illustrated in FIG. 1. As illustrated therein, the general construction of the game or sports apparatus includes a generally square platform 12 having an upper surface for supporting two or more individuals in a generally upright or crouched position.

The platform 12 may take the form of a generally square flat surface on the ground or on the floor of a gymnasium or the like. In a preferred embodiment of the invention, the platform is elevated by a support means 13 or the like, and is in the form of a square boxing ring. It may also include four posts 14, one at each corner of the ring and one or more ropes 16 which are connected to the posts 14 and enclose the ring as in a conventional boxing ring.

The platform 12 also includes two or more spaced apart designated boundary areas 18 which may have different shapes as for example a wedge-shape as shown in FIG. 1. In the preferred embodiment of the invention, the designated boundary areas are spaced apart at a distance of slightly greater than two arm lengths. This distance is preferred so that the participants in the game or sport cannot make direct contact with another participant. A line defining the confronting portion of the designated boundary area 18 serves as a foul line.

A tethered ball 20 is fixed to a tethered line 22 in a conventional manner as for example as shown in U.S. Pat. No. 4,523,762 of Garner, Sr. which is incorporated herein in its entirety by reference. The tethered ball is disposed at about the height of a participant's chest and in the space between the designated boundary areas 18. In a preferred embodiment of the invention, a generally vertical post 24 is positioned on an outer edge of the platform 12 at a position which is clear of the designated boundary areas to minimize any contact by a participant during the play of the game. The post 24 also includes a horizontal member 26 which extends over the heads of the participants.

In the preferred embodiment of the invention, the post 24 includes means for adjusting the height of the horizontal member 26. For example, the post 24 may include an outer sleeve and a plurality of vertically spaced holes. An inner sleeve on an upper part of the post 24 may also include a plurality of corresponding holes so that a pin (not shown). may be used to adjust the height. Any conventional means for height adjustment may be used.

Means for adjusting the length of the tethered line are also preferably provided. For example, the tether line 22 may extend through rings 28 and 29 and extend along the horizontal member 26, down along the post 24 and then wrapped around a cleat 30.

There are several advantages to adjusting the height of the generally horizontal member 26 and the length of the tether line 22. For example, reducing the length of the tether line between the tether ball and the participants will limit the movement of the tether ball and speed up the game. Further, the tether ball may be lowered in order to accommodate younger participants.

In one embodiment of the invention, the tethered ball 20 is not only fixed to the elastic tethered line 22 as described above, but is also fixed to a second elastic tethered line 21 or a second portion of the tethered line 22. The second elastic tethered line 21 is then fixed to the platform 12 in a conventional manner to provide a faster and more controlled response. It is also contemplated that the second elastic tethered line 21 may be attached to the platform 12 by means of an eyelet or the like so that it may be lengthened or shortened as the distance of the tethered ball 20 from the platform 12 is adjusted and/or the tension on the lines 21 and 22 are adjusted to affect the speed of a return.

It is also presently contemplated that the tether ball 20 may have several forms. For example, an inflatable ball similar to a soccer ball may be used for fast action and may be provided with an elastic tether line to add excitement to the game. Under other circumstances, a heavier medicine-type ball or the like may be used so that a participant may be forced outside of the designated area by being struck by the ball. The use of a heavier ball will require more strength by a participant while the inflatable ball will require more agility. In either case, it is contemplated that a pair of boxing-type gloves 23 will be worn by each of the participants. Such gloves may not be necessary but will provide slight padding, more realism to the game and protect the participants from abrasion of the skin on their hands.

Figure 2:
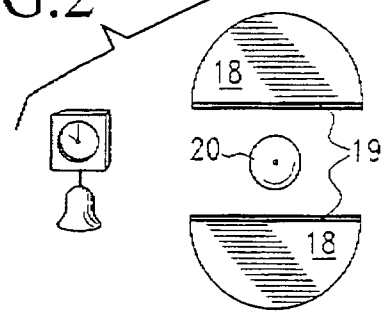
FIG. 2 is a top or plan view which illustrates two spaced apart boundary areas on a platform or other designated area in accordance with a second embodiment of the invention.

FIG. 2 shows a designated boundary area 18 wherein the shape of the boundary area is in the form of a semi-circle with the widest portion of the two semi-circles 19 in a confronting and spaced relationship. The use of a boundary layer in this form allows a participant more room to move from side to side to avoid being hit by the tethered ball 20 when an opponent strikes the ball 20. As illustrated in FIG. 2, a timer and bell may also be included to limit a round of competition in a manner which is analogous to ordinary boxing.

Figure 3:
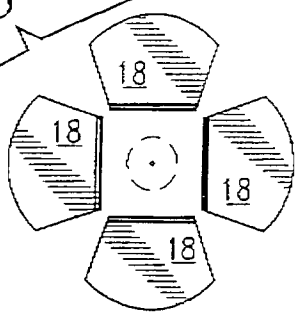
FIG. 3 is a top or plan view that illustrates a third embodiment of the invention.

A further embodiment of the invention is illustrated in FIG. 3 wherein the designated boundary areas provide for four participants to take part in a single game.

The limited contact boxing game or athletic contest is played with two or more confronting participants who are confined to their respective designated boundary areas. One of the participants begins a game by drawing the ball into their designated boundary area and from that area striking the ball with his fist towards an opponent. Stepping out of the boundary area will cause a participant to receive a penalty of a selected magnitude. For example, it may be scored as a fall in ordinary boxing. If a player deflects the ball with his gloves or arm, no penalty is incurred. However, if the ball scores a solid hit on the head or body other than a light deflection, a penalty is incurred. Thus, the game can be played using the ordinary scoring of boxing with a single referee or a judge or merely for practice with one score for direct hits against the body or head and another for stepping out of the designated boundary area 18. Finally, a foul is called if the participant steps forward of a penalty line.

Like boxing, the game can include one or more rounds of a preselected time in which case a timer and bell 30, 31 will be included with the apparatus.

Finally, it is also contemplated that the platform may include a number of phantom lines (not shown) so that the tape or other markings can be used to make the designated boundary areas of different size for participants of different ages or sizes or for other sports such as kickboxing or the like. In such cases, a tape can be used to cover those lines to indicate the actual sizes for a given game.

While the invention has been described in connection with its preferred embodiments, it should be recognized that changes and modifications may be made without departing from the scope of the appended claims.

What is claimed is:

1. Apparatus for a limited contact boxing game comprising a generally horizontal elevated platform having an upper surface for supporting two standing individuals and means for supporting said elevated platform and said platform being in the form of a square boxing ring and said upper surface including spaced apart designated boundary areas of generally equal size on said surface with one of said boundary areas for each of the individuals and said boundary areas spaced apart at a distance of greater than two arm lengths and each of said boundary areas including a foul line in a confronting and spaced relationship, a tethered ball and means for positioning said tethered ball between said designated boundary areas including a horizontal cross member and a vertical post positioned on an outer edge of said platform and clear of said designated boundary areas supporting said horizontal cross member, and a first elastic rope portion connecting said tethered ball to said cross member and a second elastic rope portion connecting said tethered ball to said platform for supporting said tethered ball between said spaced apart designated boundary areas and said tethered ball adapted to be struck by each of the individuals toward the other of the individuals and wherein said means for supporting said tethered ball includes a plurality of rings extending along said cross member and down along said vertical post and a cleat for securing said elastic rope to said vertical post for adjusting the height of said tethered ball above the generally horizontal platform; and second means including an outer sleeve on said vertical post and a plurality of holes in said outer sleeve, and a plurality of corresponding holes in said vertical post and a pin for adjusting the distance between said tethered ball and said horizontal cross member for supporting said tethered ball.

2. Apparatus for a limited contact boxing game according to claim 1 which includes four posts with one of said post at each corner of the platform and a rope connected to said posts to enclose the platform as in a conventional boxing ring.

3. Apparatus for a limited contact boxing game according to claim 2 which includes a timer and a bell to limit a round of competition in a manner which is analogous to ordinary boxing.

* * * * *